US011443905B2

(12) United States Patent
LaFountain et al.

(10) Patent No.: US 11,443,905 B2
(45) Date of Patent: Sep. 13, 2022

(54) HIGH TEMPERATURE SWITCH APPARATUS

(71) Applicant: GENERAL EQUIPMENT AND MANUFACTURING COMPANY, INC., Louisville, KY (US)

(72) Inventors: Robert L. LaFountain, Scottsburg, IN (US); Anthony Wayne Klosterman, Louisville, KY (US); Michael John Simmons, Louisville, KY (US)

(73) Assignee: GENERAL EQUIPMENT AND MANUFACTURING COMPANY, INC., Louisville, KY (US)

( * ) Notice: Subject to any disclaimer, the term of this patent is extended or adjusted under 35 U.S.C. 154(b) by 233 days.

(21) Appl. No.: 16/796,570

(22) Filed: Feb. 20, 2020

(65) Prior Publication Data

US 2021/0233724 A1 Jul. 29, 2021

Related U.S. Application Data

(60) Provisional application No. 62/965,629, filed on Jan. 24, 2020.

(51) Int. Cl.

| | |
|---|---|
| ***H01J 5/00*** | (2006.01) |
| ***H01H 13/14*** | (2006.01) |
| ***H01F 7/16*** | (2006.01) |
| ***H01H 13/06*** | (2006.01) |

(52) U.S. Cl.

CPC ..... *H01H 13/14* (2013.01); *H01F 7/1615* (2013.01); *H01H 13/06* (2013.01)

(58) Field of Classification Search

CPC ..... H01F 7/1615; H01H 13/06; H01H 13/14; H01H 13/04; H01H 36/0073; H03K 17/95

See application file for complete search history.

(56) References Cited

U.S. PATENT DOCUMENTS

| | | | | |
|---|---|---|---|---|
| 7,804,038 | B2 * | 9/2010 | Bortolus | G05B 19/0423 361/146 |
| 8,497,446 | B1 * | 7/2013 | Glaser | H01H 33/664 218/136 |
| 9,882,326 | B2 * | 1/2018 | LaFountain | G01D 5/2525 |
| 2012/0031171 | A1 * | 2/2012 | Masuda | G01N 27/4062 73/31.05 |

(Continued)

*Primary Examiner* — Bernard Rojas

(74) *Attorney, Agent, or Firm* — Hanley, Flight & Zimmerman, LLC

(57) ABSTRACT

High temperature switch apparatus are disclosed. An example apparatus includes a ceramic contact base having an opening therein configured to removably receive a contact, a first ceramic plunger housing portion and a second ceramic plunger housing portion, the first ceramic plunger housing portion including a first protrusion, the second ceramic plunger housing portion including a first recess, the first recess to receive the first protrusion, and a first ceramic contact housing portion and a second ceramic contact housing portion, the first ceramic contact housing portion including a second protrusion and a first cavity, the second ceramic contact housing portion including a second recess and a second cavity, the first ceramic plunger housing portion, the second ceramic plunger housing portion, and the ceramic contact base configured to be coupled in between the first and second cavities when the second recess receives the second protrusion.

11 Claims, 7 Drawing Sheets

(56) References Cited

U.S. PATENT DOCUMENTS

| | | | | |
|---|---|---|---|---|
| 2012/0206224 | A1* | 8/2012 | Simmons | H01H 36/0073 335/205 |
| 2015/0187518 | A1* | 7/2015 | Molyneux | H01H 50/546 335/196 |

* cited by examiner

HIGH TEMPERATURE SWITCH APPARATUS

CROSS-REFERENCE TO RELATED APPLICATIONS

This patent arises from a continuation of U.S. Provisional Patent Application Ser. No. 62/965,629, which was filed on Jan. 24, 2020. U.S. Provisional Patent Application Ser. No. 62/965,629 is hereby incorporated herein by reference in its entirety. Priority to U.S. Provisional Patent Application Ser. No. 62/965,629 is hereby claimed.

FIELD OF THE DISCLOSURE

This disclosure relates generally to switches and, more particularly, to a high temperature switch apparatus.

BACKGROUND

A switch often includes an actuator such as a button or a lever. Typically, a portion of the actuator is conductive. When the actuator is moved from a first position to a second position, the conductive portion of the actuator generally engages (i.e., closes) or disengages (i.e., opens) one or more sets of electrical contacts. In some switches, a spring moves the actuator back to the first position to reset the switch.

SUMMARY

An example apparatus includes a ceramic contact base having an opening therein configured to removably receive a contact, a first ceramic plunger housing portion and a second ceramic plunger housing portion, the first ceramic plunger housing portion including a first protrusion, the second ceramic plunger housing portion including a first recess, the first recess to receive the first protrusion, and a first ceramic contact housing portion and a second ceramic contact housing portion, the first ceramic contact housing portion including a second protrusion and a first cavity, the second ceramic contact housing portion including a second recess and a second cavity, the first ceramic plunger housing portion, the second ceramic plunger housing portion, and the ceramic contact base configured to be coupled between the first and second cavities when the second recess receives the second protrusion.

An example apparatus includes a contact assembly including a first contact, a second contact, and a third contact, a first deformable metallic sleeve including a proximal end and a distal end, the proximal end crimped to the first contact, the distal end crimped to a first conductor, a second deformable metallic sleeve including a proximal end and a distal end, the proximal end crimped to the second contact, the distal end crimped to a second conductor, a third deformable metallic sleeve including a proximal end and a distal end, the proximal end crimped to the third contact, the distal end crimped to a third conductor, and a switch actuator to translate the third contact when an object is within a threshold sensing zone of the magnetically-triggered proximity switch.

Figure 1:
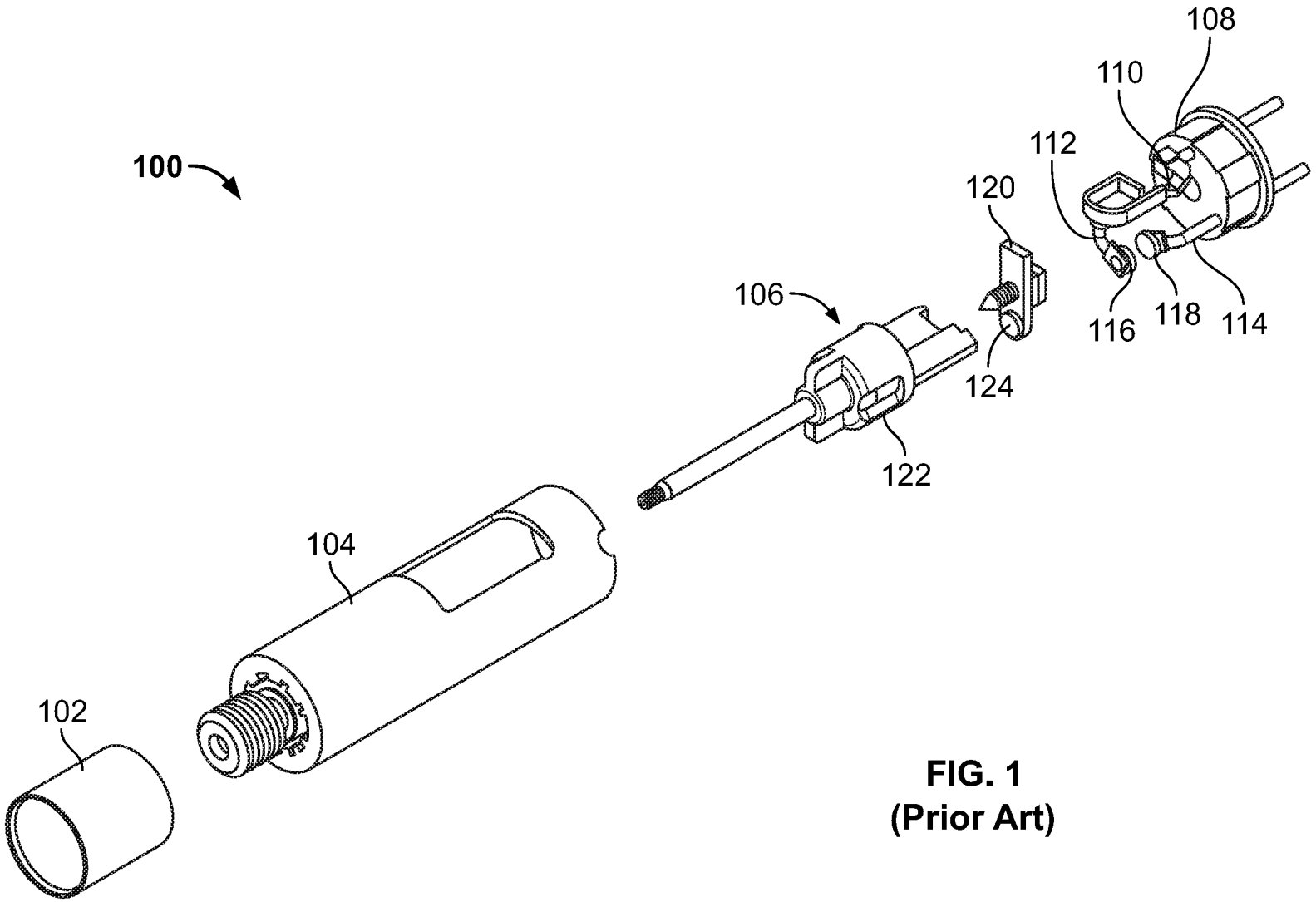
FIG. 1 (Prior Art)
FIG. 1 illustrates a first known type of switch.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

A proximity switch is operable to detect the presence of nearby objects not coupled directly to the proximity switch. For example, a proximity switch may identify vibration measurements in machinery, mechanical device location, etc. In operation, a proximity switch may open or close an electrical circuit using a plurality of contacts responsive to a change in an electromagnetic field, a beam of electromagnetic radiation (e.g., infrared, etc.), etc., emitted from and returned to the proximity switch. As such, proximity switches enable a reliable and long-lasting functional life as compared to mechanical switches because of, at least, a lack of physical contact between the proximity switch and the sensed object.

Proximity switches are typically designed and manufactured to operate in a low-heat environment. As used herein, a low-heat environment is an environment including temperatures up to 350 degrees Fahrenheit. For example, magnetically-triggered proximity switches are typically designed using single epoxy over-molded housings to couple and/or otherwise house components in the switch. In some instances, proximity switches that operate in a low-heat environment are electrically coupled (e.g., conductive contacts in the switch are coupled to one or more electrical conductors) using solder on a printed circuit board (PCB) potted with an epoxy. Such example proximity switches have an increased likelihood of failure in high-heat environments (e.g., switch destruction, switch degradation, component failure, etc.). As used herein, a high-heat environment is an environment including temperatures greater than 350 degrees Fahrenheit. Likewise, as used herein, a device, material, and/or substance rated to withstand temperatures in a high-heat environment refers to a device, material, and/or substance suited to efficiently and properly operate at temperatures included in a high-heat environment.

Examples disclosed herein include methods and apparatus to operate switches (e.g., proximity switches) in high-heat environments. Examples disclosed herein include mechanically coupling (e.g., crimping conductive contacts in the switch to one or more electrical conductors) using a material rated to withstand temperatures in a high-heat environment (e.g., stainless steel, etc.). As such, examples disclosed herein enable electrical conductivity and efficient switch operation in a high-heat environment. In some examples disclosed herein, a proximity switch may be mechanically coupled using micro stainless steel tubing that is crimped.

To enable efficient operation of a proximity switch in a high-heat environment, examples disclosed herein utilize at least one two-part (e.g., two portion) housing to couple at least one contact in the proximity switch. For example, a switch housing is separated into a first housing portion and a second housing portion in which at least one contact is coupled between the first housing portion and the second housing portion. In such an example, the proximity switch can be designed using a material rated to withstand temperatures in a high-heat environment such as ceramic, glass, an inorganic material, and/or any suitable electrically insulating material rated to withstand temperatures in a high-heat environment.

Examples disclosed herein further enable efficient operation of a proximity switch in high-heat environments by utilizing a contact base designed to enable insertion and/or removal of contacts. As such, the contact base is composed of a material rated to withstand temperatures in a high-heat environment such as ceramic, glass, and/or any suitable insulating material rated to withstand temperatures in a high-heat environment.

FIG. 1 illustrates a first known type of switch 100. The switch 100 is shown in an exploded view. The switch 100 includes a primary magnet assembly 102, a contact housing 104, a plunger assembly 106, and a contact base 108. A bias magnet is coupled inside the contact housing 104. The contact base 108 includes a flexible conductor 110, a first contact leaf 112, and a second contact leaf 114. The first contact leaf 112 includes a first contact pad 116. The second contact leaf 114 includes a second contact pad 118. The contact base 108 is a single, plastic over-molded assembly configured to house the plunger assembly 106, the contact base 108, and a plunger tab 120. The plunger assembly 106 is housed by a single, plastic over-molded assembly 122. When assembled, the flexible conductor 110 is welded to the plunger tab 120. Additionally, the flexible conductor 110, the first contact leaf 112, and the second contact leaf 114 are stationary with respect to the contact base 108.

In operation, the presence of a target (e.g., an external magnet, a ferrous object, etc.) proximate to (i.e., within a sensing field) the switch 100 causes movement of the plunger assembly 106. When assembled, the plunger assembly 106 is coupled to the primary magnet assembly 102 and, thus, the plunger assembly 106 and the primary magnet assembly 102 are caused to translate with respect to the contact housing 104 (e.g., within the contact housing 104) by a repulsive or attractive force, thereby electrically coupling or de-coupling the first and second contact pads 116, 118 and a plunger contact pad 124 to and/or from one another.

In contrast to the known switch 100 shown in FIG. 1, examples disclosed herein employ methods and apparatus to ensure efficient switch operations in high-heat environments. In some examples disclosed herein, a flexible conductor and contact leaves are inserted into a contact assembly produced using a material rated to withstand temperatures in a high-heat environment such as ceramic, glass, an inorganic material, or any suitable electrically insulating material rated to withstand temperatures in a high-heat environment. In some examples disclosed herein, a contact housing is separated into two contact housing portions. Likewise, in some examples disclosed herein, a plunger housing is separated into two plunger housing portions. In this manner, the contact housing and plunger housing portions can be produced using a material (e.g., ceramic, glass, an inorganic material, etc.) rated to withstand temperatures in a high-heat environment and configured to be mechanically coupled together.

Figure 2:
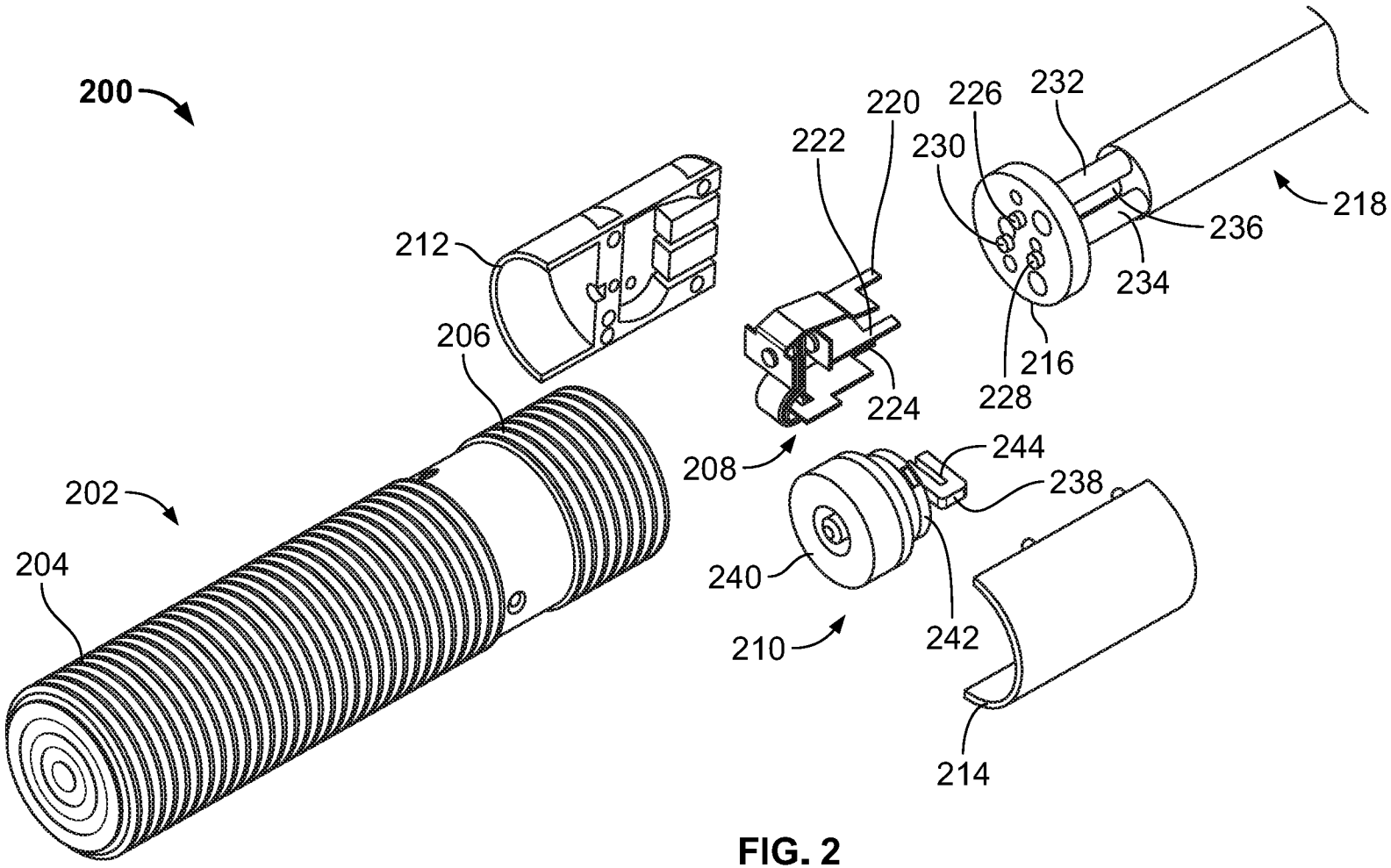
FIG. 2 (Prior Art)
FIG. 2 illustrates a second known type of switch.

FIG. 2 illustrates a second known type of switch 200. The second switch 200 is shown in an exploded view. The second switch 200 functions as a magnetically triggered proximity switch and/or sensor. The second switch 200 includes a threaded portion 202 with threads 204, 206, a contact assembly 208, a primary magnet assembly 210, a first housing portion 212, a second housing portion 214, a PCB 216, and a set of conductors 218. In FIG. 2, the switch 200, when assembled, is potted with a silicone potting substance. The contact assembly 208 includes a first contact leaf 220, a second contact leaf 222, and a third contact leaf 224. The PCB 216 includes a first pad 226, a second pad 228, and a third pad 230.

When assembled, the contact leaves 220, 222, 224 are electrically coupled (e.g., soldered) to the respective pads 226, 228, 230. In addition, the first contact leaf 220 is electrically coupled to a first conductor 232 of the set of conductors 218, the second contact leaf 222 is electrically coupled to a second conductor 234 of the set of conductors 218, and the third contact leaf 224 is electrically coupled to a third conductor 236 of the set of conductors 218. When assembled, the first contact leaf 220 and the second contact leaf 222 remain stationary in the first housing portion 212 and the second housing portion 214, respectively.

The primary magnet assembly 210 includes a switch actuator 238, a first magnet 240, and a second magnet 242. When assembled, a fork 244 of the switch actuator 238 is mechanically coupled to the first magnet 240, and the fork 244 engages the third contact leaf 224 when assembled.

In operation, the presence of a target (e.g., an external magnet, a ferrous object, etc.) proximate to (i.e., within a sensing field) causes movement of the first magnet 240, thereby causing the switch actuator 238 and, thus, the fork 244 to translate and electrically couple and/or decouple the contact leaves 220, 222, 224. In particular, the switch actuator 238 is caused to translate by a repulsive or attractive force caused by at least the primary magnet assembly 210, thereby electrically coupling or de-coupling the contact leaves 220, 222, 224 to/from one another.

In FIG. 2, the first housing portion 212 and the second housing portion 214 are plastic, over-molded components. Similarly, the first conductor 232, the second conductor 234, and the third conductor 236 are individually insulated using an elastomeric jacket. The first magnet 240 and the second magnet 242 are rated to operate in a low-heat environment (e.g., rare earth magnets).

In contrast to the switch 200 of FIG. 2, examples disclosed herein include crimping example first, second, and third contacts to example first, second, and third conductors. In such a manner, a PCB is not needed and, as such, a potting material rated to withstand temperatures in a high-heat environment (e.g., a ceramic epoxy) may be used to pot the example switch. Such examples are not feasible in the switch 200 of FIG. 2 because the PCB, or solder joints, will not operate efficiently in a high-heat environment.

Figure 3:
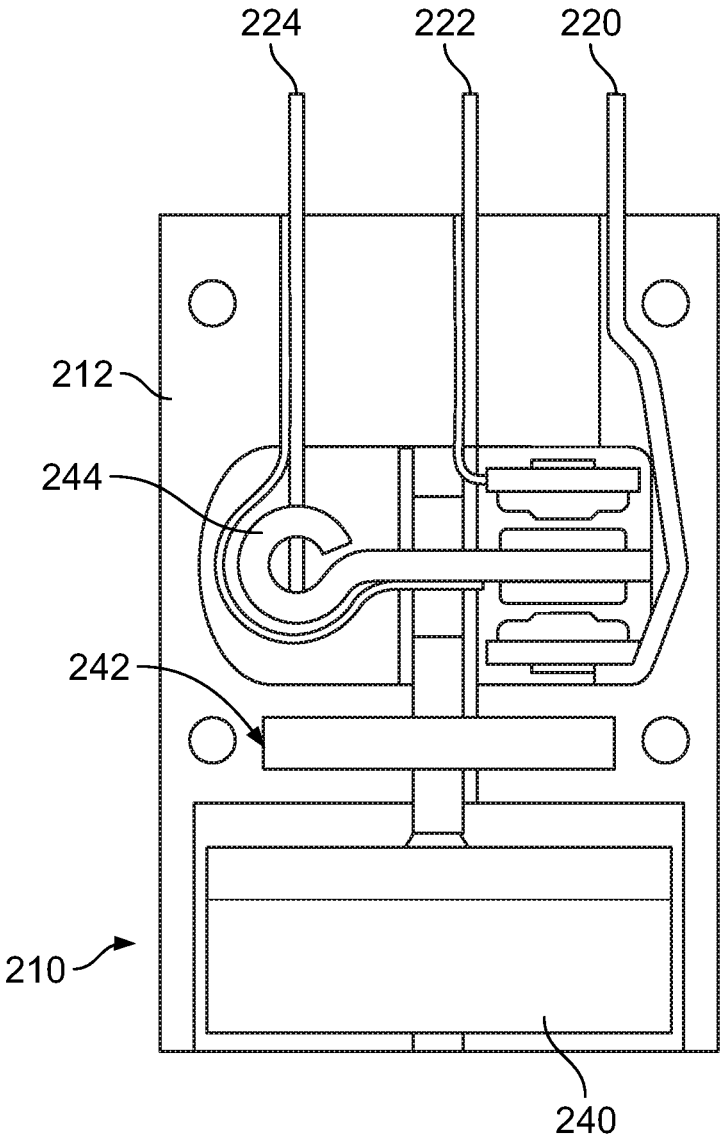
FIG. 3 (Prior Art)
FIG. 3 illustrates a cross-sectional view of the primary magnet assembly of FIG. 2 when assembled in the first housing portion of FIG. 2.

FIG. 3 illustrates a cross-sectional view of the primary magnet assembly 210 of FIG. 2 when assembled in the first housing portion 212 of FIG. 2. The illustration of FIG. 3 includes the first contact leaf 220, the second contact leaf 222, the third contact leaf 224, the first magnet 240, the second magnet 242, and the fork 244.

Figure 4:
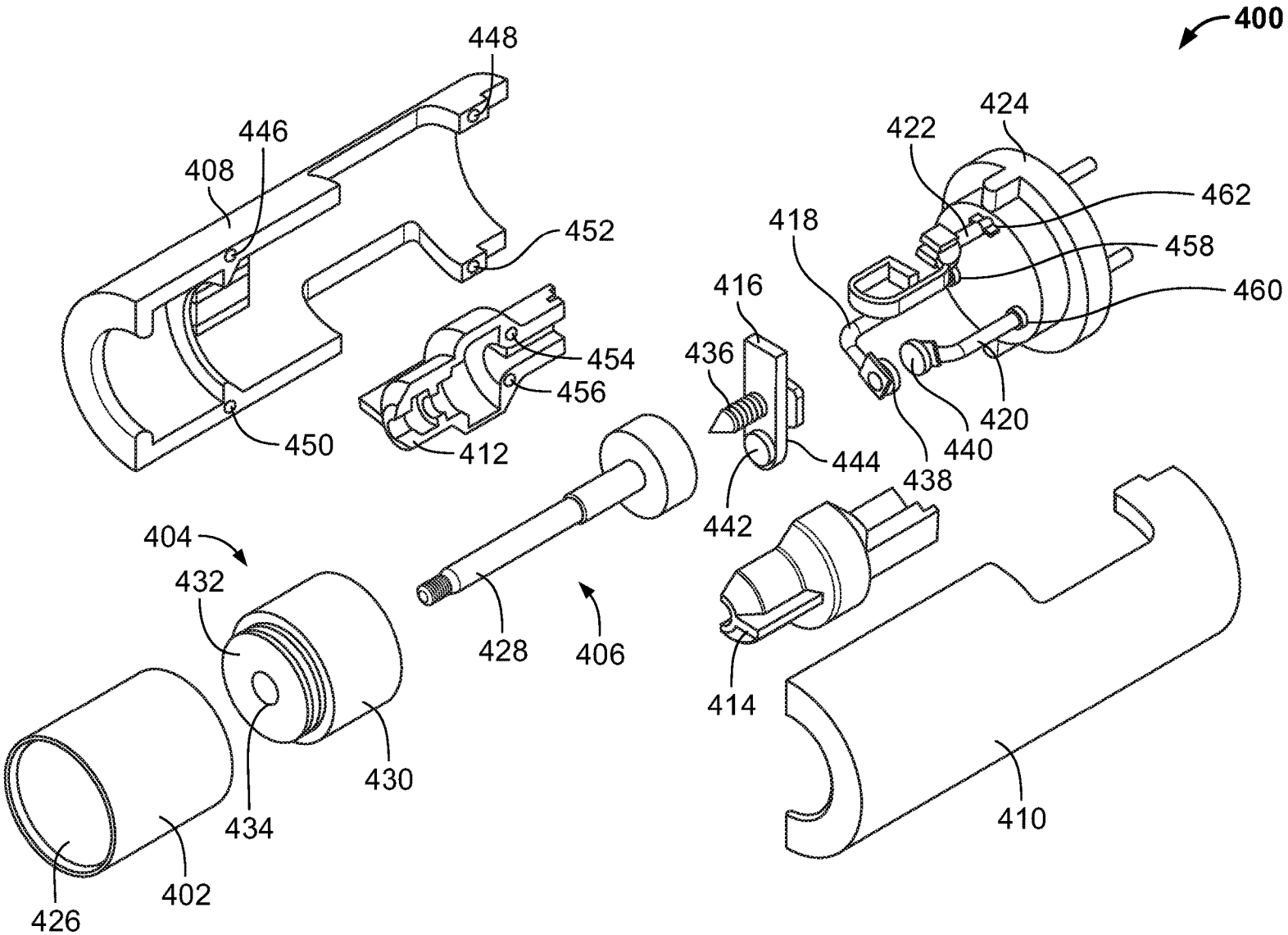
FIG. 4 illustrates an exploded view of an example switch in accordance with teachings of this disclosure.

FIG. 4 illustrates an exploded view of an example switch 400 in accordance with teachings of this disclosure. The switch 400 includes an example primary magnet assembly 402, an example bias magnet assembly 404, an example plunger assembly 406, an example first contact housing portion 408, an example second contact housing portion 410, an example first plunger housing portion 412, an example second plunger housing portion 414, an example tab 416, an example first contact leaf 418, an example second contact leaf 420, an example flexible conductor 422, and an example contact base 424. In examples disclosed herein, a contact leaf may be referred to as a contact. Similar to the known switch 100 of FIG. 1, the switch 400 of the illustrated example is proximity-based such that an electrical switch is operated based on a detected presence of a target, such as an external magnet or a ferrous object (e.g., an object with sufficient mass of ferrous material), for example.

In the illustrated example of FIG. 4, the primary magnet assembly 402 includes an example primary magnet 426 produced using rare earth metals rated to withstand temperatures in a high-heat environment. In some examples disclosed herein, the primary magnet 426 may be a samarium cobalt magnet rated to withstand temperatures in a high-heat environment. Alternatively, in other examples, the primary magnet 426 may be any suitable magnetic object (e.g., a ferrous object) rated to withstand temperatures in a high-heat environment (e.g., a neodymium magnet rated to withstand temperatures in a high-heat environment, etc.). The primary magnet 426, and more generally, the primary magnet assembly 402, is mechanically coupled (e.g., screwed, welded, etc.), to an example shaft 428 of the plunger assembly 406. The bias magnet assembly 404 includes an example bias magnet 430 produced using rare earth metals rated to withstand temperatures in a high-heat environment. In some examples, the bias magnet 430 may be a samarium cobalt magnet rated to withstand temperatures in a high-heat environment. Alternatively, in other examples, the bias magnet 430 may be any suitable magnetic object (e.g., a ferrous object) rated to withstand temperatures in a high-heat environment (e.g., a neodymium magnet rated to withstand temperatures in a high-heat environment, etc.). The bias magnet assembly 404 further includes an example cylindrical interface 432 (e.g., a bushing) that is coupled to the bias magnet assembly 404 and the primary magnet assembly 402, when assembled. The bias magnet assembly 404 includes an example bore 434 extending therethrough to receive the shaft 428 of the plunger assembly 406. In this manner, the shaft 428, when assembled, passes though the bore 434 of the bias magnet assembly 404 to be mechanically coupled to the primary magnet 426.

In the example illustrated in FIG. 4, the tab 416 is mechanically coupled to the plunger assembly 406 via an example threaded shaft 436. When assembled, the flexible conductor 422 is welded to the tab 416. In examples disclosed herein, the flexible conductor 422 may be welded to the tab 416 using any suitable welding method such as, for example, resistive welding. When assembled, the tab 416 is configured to be positioned in parallel between an example first contact pad 438 of the first contact leaf 418 and an example second contact pad 440 of the second contact leaf 420. In this manner, an example first contact pad 442 of the tab 416 may be electrically coupled to the first contact pad 438 of the first contact leaf 418, or an example second contact pad 444 may be electrically coupled to the second contact pad 440 of the second contact leaf 420.

In FIG. 4, the first contact pad 438 of the first contact leaf 418, the second contact pad 440 of the second contact leaf 420, the first contact pad 442 of the tab 416, and/or the second contact pad 444 of the tab 416 are produced using any electrically conductive material rated to withstand temperatures in a high-heat environment. For example, the first contact pad 438 of the first contact leaf 418, the second contact pad 440 of the second contact leaf 420, the first contact pad 442 of the tab 416, and/or the second contact pad 444 of the tab 416 may be platinum, silver tin oxide, plated with gold-flashed silver cadmium oxide, etc. In other examples, the first contact pad 438 of the first contact leaf 418, the second contact pad 440 of the second contact leaf 420, the first contact pad 442 of the tab 416, and/or the second contact pad 444 of the tab 416 may be produced using any suitable conductive material.

In the example illustrated in FIG. 4, the first contact housing portion 408 and the second contact housing portion 410 are ceramic housing portions. In other examples, the first contact housing portion 408 and/or the second contact housing portion 410 may be molded using a suitable material rated to withstand temperatures in a high-heat environment such as, for example, ceramic epoxy, an inorganic material, etc. Alternatively, in other examples, the first contact housing portion 408 and/or the second contact housing portion 410 may be any suitable electrically insulating material rated to withstand temperatures in a high-heat environment such as, for example, a plastic rated to withstand temperatures in a high-heat environment (e.g., polyimide, poly benz imidazol, etc.), etc. The first contact housing portion 408 and/or the second contact housing portion 410, when assembled, form a single contact housing (e.g., a single ceramic contact housing) to enclose the bias magnet assembly 404, the plunger assembly 406, the first plunger housing portion 412, the second plunger housing portion 414, the tab 416, the first contact leaf 418, the second contact leaf 420, and the flexible conductor 422.

In the example illustrated in FIG. 4, the first plunger housing portion 412 and the second plunger housing portion 414 are ceramic plunger housing portions. In other examples, the first plunger housing portion 412 and/or the second plunger housing portion 414 may be molded using a suitable material rated to withstand temperatures in a high-heat environment such as, for example, ceramic epoxy. Alternatively, in other examples, the first plunger housing portion 412 and/or the second plunger housing portion 414 may be any suitable electrically insulating material rated to withstand temperatures in a high-heat environment such as, for example, a rated plastic rated to withstand temperatures in a high-heat environment (e.g., polyimide, poly benz imidazol, etc.), etc. The first plunger housing portion 412 and/or the second plunger housing portion 414, when assembled, form a single plunger housing (e.g., a single ceramic plunger housing) to enclose the plunger assembly 406, a portion of the shaft 428, and the threaded shaft 436 mechanically coupled to the plunger assembly 406.

In the example illustrated in FIG. 4, the contact base 424 is a ceramic contact base. In other examples, the contact base 424 may be molded using a suitable material rated to withstand temperatures in a high-heat environment such as, for example, ceramic epoxy, an inorganic material, etc. Alternatively, in other examples, the contact base 424 may be any suitable electrically insulating material rated to withstand temperatures in a high-heat environment such as, for example, a plastic rated to withstand temperatures in a high-heat environment (e.g., polyimide, poly benz imidazol, etc.), etc. The contact base 424 includes example openings 458, 460, 462 configured to receive the first contact leaf 418, the second contact leaf 420, and the flexible conductor 422, respectively. For example, the first contact leaf 418, the second contact leaf 420, and/or the flexible conductor 422 are removably coupled (e.g., inserted) to the openings 458, 460, 462 of the contact base 424. For example, the openings 458, 460, 462 are configured to removably receive the first contact leaf 418, the second contact leaf 420, and the flexible conductor 422, respectively. Further, rather than a unitary over-molded assembly, as in FIG. 1, the first contact leaf 418, the second contact leaf 420, and/or the flexible conductor 422 are removable from the contact base 424. For example, because the contact base 424 is a ceramic contact base, the first contact leaf 418, the second contact leaf 420, and/or the flexible conductor 422 may be inserted and/or removed. In this manner, the contact base 424 may be produced using methods other than over-molding, to enable the insertion and/or removal of the first contact leaf 418, the second contact leaf 420, and/or the flexible conductor 422. A detailed illustration of the example contact base 424, including the openings 458, 460, 462, is described below in connection with FIG. 5.

The first contact leaf 418, the second contact leaf 420, and the flexible conductor 422 are produced using an electrically conductive material rated to withstand temperatures in a high-heat environment. For example, the first contact leaf 418, the second contact leaf 420, and/or the flexible conductor 422 may be produced using beryllium copper. The first contact leaf 418, the second contact leaf 420, and the flexible conductor 422, when assembled in a body tube and/or housing, are purged with nitrogen to remove and/or otherwise displace oxygen. Purging the assembly with nitrogen removes oxygen to enable efficient operation in high-heat environments (e.g., temperatures greater than or equal to 350 degrees Fahrenheit) with a minimal risk of oxidation.

In the example illustrated in FIG. 4, the first contact housing portion 408 includes example protrusions 446, 448 and example recesses 450, 452. While not shown, the example second housing portion 410 includes corresponding example recesses configured to receive the protrusions 446, 448, when assembled. Additionally, while not shown, the example second housing portion 410 includes corresponding example protrusions configured to be received by the recesses 450, 452, when assembled. While FIG. 4 illustrates the example protrusions 446, 448 as cylindrical protrusions (e.g., pins), any suitable shape may be utilized to implement the protrusions 446, 448. Likewise, while FIG. 4 illustrates the example recesses 450, 452 as cylindrical recesses, any suitable shape may be utilized to implement the recesses 450, 452. For example, the cross-sections of the protrusions 446, 448 could be any suitable shape such as, for example, a rectangular cross-section, a triangular cross-section, etc., configured to fit into and/or otherwise interlock with the respective recesses 450, 452. In another example, the cross-sections of the recesses 450, 452 could be any suitable shape such as, for example, a rectangular cross-section, a triangular cross-section, etc., configured to receive and/or otherwise interlock with the respective protrusions 446, 448.

In other examples, the first contact housing portion 408 may include any suitable number of protrusions and/or recesses, located in any suitable corresponding manner (e.g., all protrusions on one side, protrusions and recesses both on one side, etc.). Likewise, in other examples, the second contact housing portion 410 may include any suitable number of protrusions and/or recesses, located in any suitable corresponding manner (e.g., all protrusions on one side, protrusions and recesses both on one side, etc.).

In other examples, the example switch 400 may be potted with a potting material rated to withstand temperatures in a high-heat environment (e.g., a ceramic epoxy). In this manner, the example switch 400, when assembled and potted, may be hermetically sealed (e.g., airtight), vacuum sealed, water sealed, etc.

Similarly, the example first plunger housing portion 412 includes an example protrusion 454 and an example recess 456. While not shown, the example second plunger housing portion 414 includes a corresponding example recess configured to receive the protrusion 454. Additionally, while not shown, the example second plunger housing portion 414 includes a corresponding example protrusion configured to be received by the recess 456, when assembled. While FIG. 4 illustrates the example protrusion 454 as a cylindrical protrusion (e.g., a pin), any suitable shape may be utilized to implement the protrusion 454. Likewise, while FIG. 4 illustrates the example recess 456 as a cylindrical recess, any suitable shape may be utilized to implement the recess 456. For example, the cross-section of the protrusion 454 could be any suitable shape such as, for example, a rectangular cross-section, a triangular cross-section, etc., configured to fit into and/or otherwise interlock with the respective recess 456. In another example, the cross-section of the recess 456 could be any suitable shape such as, for example, a rectangular cross-section, a triangular cross-section, etc., configured to receive and/or otherwise interlock with the respective protrusion 454.

In other examples, any suitable number of protrusions and/or recesses may be utilized to couple the first plunger housing portion 412 and the second plunger housing portion 414.

While three sets of contact leaves are shown in the example of FIG. 4, any appropriate number of contact leaves can be implemented instead (e.g., four, five, ten, twenty, fifty, one hundred, etc.). In some alternative examples, the shaft 428 is biased by a spring (e.g., a linear spring). While the example of FIG. 4 illustrates a single pole double throw switch, in some examples, a double-pole double throw switch may be implemented. Additionally, in other examples, the switch 400 of FIG. 4 may be a quick disconnect coupled switch. For example, when assembled, the first contact housing portion 408 may be coupled to the second contact housing portion 410 via any suitable quick disconnect method or apparatus. Likewise, when assembled, the first plunger housing portion 412 may be coupled to the second plunger housing portion 414 via any suitable quick disconnect method or apparatus. In yet another example, the contact base 424 may be implemented suing any suitable quick disconnect method or apparatus to enable quick disconnect to an external system, device, and/or apparatus. Alternatively, any of the materials and/or methods disclosed herein may be utilized to insulate the switch 400 for increased transient temperature resistance.

Figure 5:
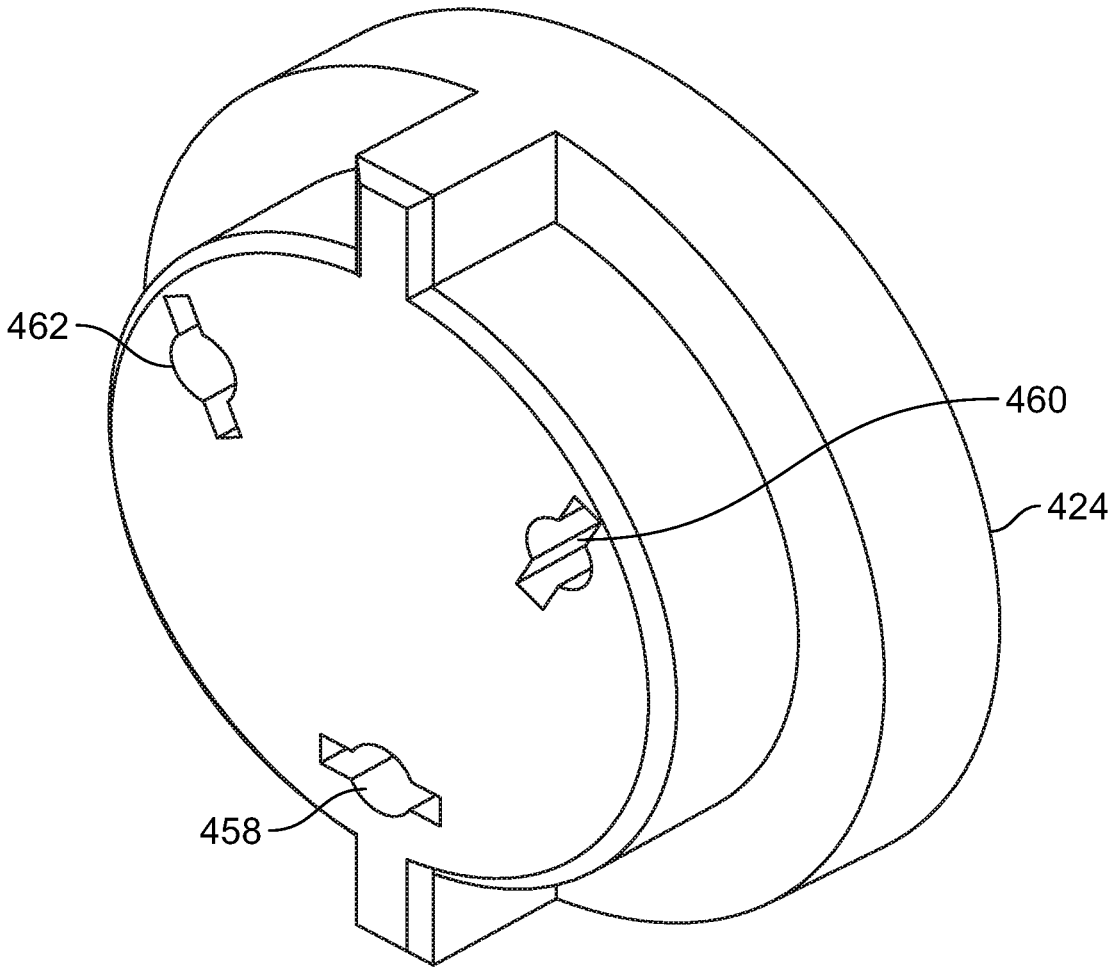
FIG. 5 is an isometric view of the example contact base of FIG. 4.

FIG. 5 is an isometric view of the example contact base 424 of FIG. 4. In FIG. 5, the openings 458, 460, 462 are illustrated as passages extending through the contact base 424. The openings 458, 460, 462 are keyed openings to prevent rotational movement of the first contact leaf 418, the second contact leaf 420, and the flexible conductor 422. While FIG. 5 illustrates the openings 458, 460, 462 as cylindrical in shape with rectangular cross-sectional legs, any suitable shape of opening may be utilized to receive a respective contact. For example, the openings 458, 460, 462 may be keyed in any suitable manner (e.g., cylindrical in shape with a single rectangular cross-sectional leg, etc.). In some examples, the cross section of the openings 458, 460, 462 may be wider at the receiving end, while narrower at the opposing end. In this manner, a change in width of the openings 458, 460, 462 can impart physical pressure on the first contact leaf 418, the second contact leaf 420, and the flexible conductor 422 to frictionally engage and retain (e.g., via an interference fit) the first contact leaf 418, the second contact leaf 420, and the flexible conductor 422. In this example, the first contact leaf 418, the second contact leaf 420, and the flexible conductor 422 extend fully though through the contact base 424.

Alternatively, in other examples, the openings 458, 460, 462 may not extend fully though the contact base 424. For example, the openings 458, 460, 462 may extend a fixed distance into the contact base 424. In this manner, an electrically conductive material such as, for example, copper rated to withstand temperatures in a high-heat environment, may be inserted in the opposing side to provide an electrically conductive path through the entire contact base 424.

Figure 6:
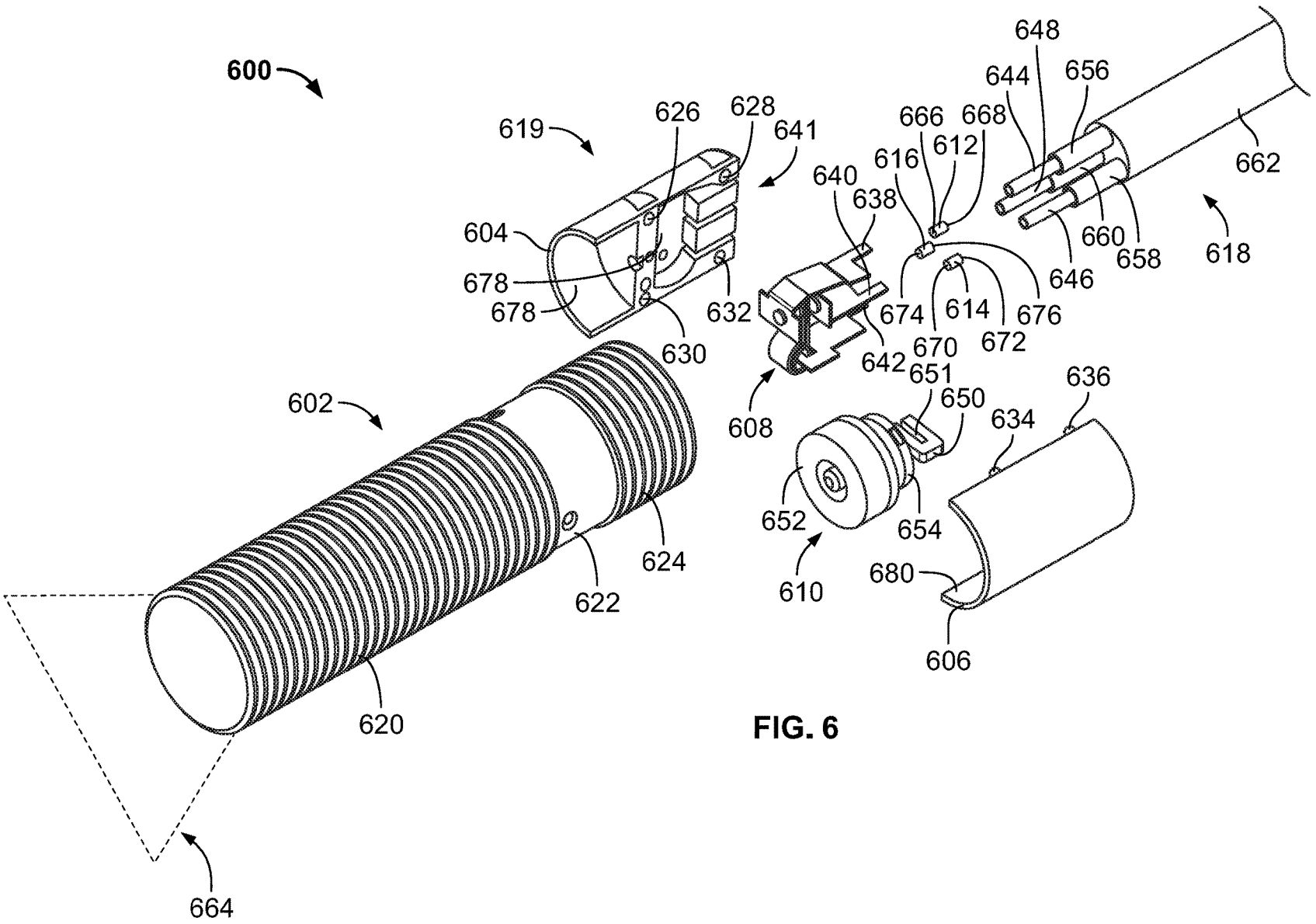
FIG. 6 is an exploded view of an alternative example switch in accordance with teachings of this disclosure.

FIG. 6 is an exploded view of an alternative example switch 600 in accordance with teachings of this disclosure. The switch 600 includes an example shaft 602, an example first contact housing portion 604, an example second contact housing portion 606, an example contact assembly 608, an example magnet assembly 610, an example first deformable sleeve 612, an example second deformable sleeve 614, an example third deformable sleeve 616, and an example set of conductors 618. When assembled, the first contact housing portion 604, the second contact housing portion 606, the contact assembly 608, and the magnet assembly 610 may be collectively referred to as an example actuator assembly 619.

In the example illustrated in FIG. 6, the shaft 602 includes an example first threaded section 620, an example non-threaded section 622, and an example second threaded section 624. The shaft 602 is a hollow shaft configured to receive the first contact housing portion 604, the second contact housing portion 606, the contact assembly 608, the magnet assembly 610, the first deformable sleeve 612, the second deformable sleeve 614, the third deformable sleeve 616, and a portion of the set of conductors 618 when assembled. The shaft 602 is produced using a material rated to withstand temperatures in a high-heat environment such as, for example, a high melting point metal (e.g., tungsten, molybdenum, tantalum, niobium, stainless steel, etc.), a plastic rated to withstand temperatures in a high-heat environment (e.g., polyimide, poly benz imidazol, etc.), etc.

In the example illustrated in FIG. 6, the first contact housing portion 604 and the second contact housing portion 606 are ceramic housings. In other examples, the first contact housing portion 604 and/or the second contact housing portion 606 may be molded using a suitable material rated to withstand temperatures in a high-heat environment such as, for example, ceramic epoxy, an inorganic material. Alternatively, in other examples, the first contact housing portion 604 and/or the second contact housing portion 606 may be any suitable electrically insulating material rated to withstand temperatures in a high-heat environment such as, for example, a plastic rated to withstand temperatures in a high-heat environment (e.g., polyimide, poly benz imidazol, etc.), etc. The first contact housing portion 604 and/or the second contact housing portion 606, when assembled, enclose the contact assembly 608 and the magnet assembly 610.

In other examples, the example switch 600 may be potted with a potting material rated to withstand temperatures in a high-heat environment (e.g., a ceramic epoxy). In this manner, the example switch 600, when assembled and potted, may be hermetically sealed (e.g., airtight), vacuum sealed, water sealed, etc.

In the illustrated example of FIG. 6, the first contact housing portion 604 includes example recesses 626, 628, 630, 632 and an example cavity 678. The second contact housing portion 606 includes example protrusions 634, 636 and an example cavity 680. In such a manner, the first contact housing portion 604 and/or the second contact housing portion 606, when assembled, enclose the contact assembly 608 and the magnet assembly 610 between the cavities 678, 680. In the example illustrated in FIG. 6, the first contact housing portion 604 and the second contact housing portion 606 are not over molded as a single contact housing. As such, the contact housing portion 604 and/or the second contact housing portion 606 can be produced using a material rated to withstand temperatures in a high-heat environment such as, for example, ceramic, ceramic epoxy, a plastic rated to withstand temperatures in a high-heat environment (e.g., polyimide, poly benz imidazol, etc.), an inorganic material, etc. In this manner, the recesses 626, 628, 630, 632 of the first contact housing portion 604 are configured to receive example protrusions 634, 636, along with two protrusions not illustrated, of the second contact housing portion 606, when assembled as a single contact housing portion.

While FIG. 6 illustrates the example recesses 626, 628, 630, 632 as cylindrical recesses, any suitable shape may be utilized to implement the recesses 626, 628, 630, 632. Likewise, while FIG. 6 illustrates the example protrusions 634, 636 as cylindrical protrusions (e.g., pins), any suitable shape may be utilized to implement the protrusions 634, 636. For example, the cross-sections of the recesses 626, 628, 630, 632 could be any suitable shape such as, for example, a rectangular cross-section, a triangular cross-section, etc., configured to fit into and/or otherwise interlock with the respective protrusions 634, 636, etc. In another example, the cross-sections of the protrusions 634, 636 could be any suitable shape such as, for example, a rectangular cross-section, a triangular cross-section, etc., configured to receive and/or otherwise interlock with the respective recesses 626, 628, 630, 632.

While FIG. 6 illustrates the example protrusions 634, 636 configured to be inserted into the example recesses 626, 628, respectively, additional corresponding protrusions are configured to be inserted into the recesses 630, 632. In other examples, any number of corresponding recesses and/or protrusions may be used. For example, the first contact housing portion 604 may include two recesses configured to receive two corresponding protrusions on the second contact housing portion 606.

In the example illustrated in FIG. 6, the contact assembly 608 includes an example first contact leaf 638, an example second contact leaf 640, and an example third contact leaf 642. The first contact leaf 638, the second contact leaf 640, and the third contact leaf 642 are produced using an electrically conductive material rated to withstand temperatures in a high-heat environment. For example, first contact leaf 638, the second contact leaf 640, and the third contact leaf 642 may be produced using beryllium copper. Alternatively, in other examples, the first contact leaf 638, the second contact leaf 640, and the third contact leaf 642 may be produced using any suitable conductive material.

The first contact leaf 638, the second contact leaf 640, and the third contact leaf 642, when assembled in a body tube and/or housing, are purged with nitrogen to remove oxygen. Further, purging the switch 600, when assembled, with nitrogen removes oxygen to enable efficient operation in high-heat environments (e.g., temperatures greater than or equal to 350 degrees Fahrenheit) with a minimal possibility of oxidation.

When assembled, the first contact leaf 638 is electrically and/or otherwise mechanically coupled (e.g., crimped) to an example first conductor 644 via the first deformable sleeve 612. For example, when assembled, the first deformable sleeve 612 receives an example end of the first conductor 644 and the first contact leaf 638. When pressure is applied to the first deformable sleeve 612, the first deformable sleeve 612 becomes deformed and electrically and/or otherwise mechanically couples the first conductor 644 and the first contact leaf 638. More specifically, an example proximal end 666 of the first deformable sleeve 612 receives the first contact leaf 638. Likewise, an example distal end 668 of the first deformable sleeve 612 receives the first conductor 644.

Similarly, the second contact leaf 640 is electrically and/or otherwise mechanically coupled (e.g., crimped) to an example second conductor 646 via the second deformable sleeve 614. For example, when assembled, the second deformable sleeve 614 receives an example end of the second conductor 646 and the second contact leaf 640 and, when pressure is applied, the second deformable sleeve 614 becomes deformed and electrically and/or otherwise mechanically couples the second conductor 646 and the second contact leaf 640. More specifically, an example proximal end 670 of the second deformable sleeve 614 receives the second contact leaf 640. Likewise, an example distal end 672 of the second deformable sleeve 614 receives the second conductor 646.

In the example illustrated in FIG. 6, the third contact leaf 642 is electrically and/or otherwise mechanically coupled (e.g., crimped) to an example third conductor 648 via the third deformable sleeve 616. For example, when assembled, the third deformable sleeve 616 receives an example end of the third conductor 648 and the third contact leaf 642 and, when pressure is applied, the third deformable sleeve 616 becomes deformed and electrically and/or otherwise mechanically couples the third conductor 648 and the third contact leaf 642. More specifically, an example proximal end 674 of the third deformable sleeve 616 receives the third contact leaf 642. Likewise, an example distal end 676 of the third deformable sleeve 616 receives the third conductor 648.

Figure 7:
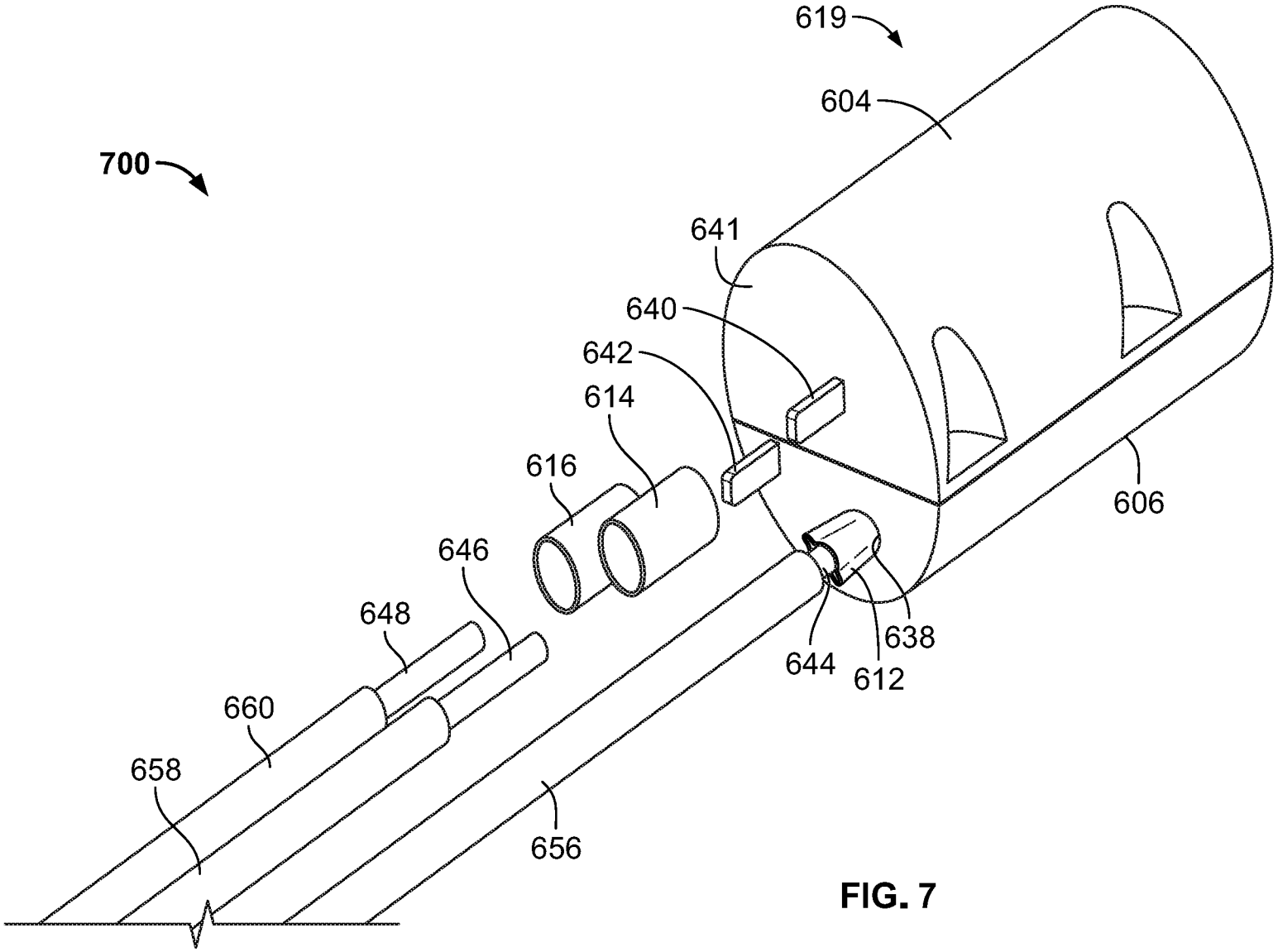
FIG. 7 is an enlarged view of the example actuator assembly of FIG. 6 and example first, second, and third deformable sleeves.

Further, when assembled, the first contact leaf 638, the second contact leaf 640, and the third contact leaf 642 are configured to extend to a first, second, and third distance, respectively, external to an example face 641 of the first and second contact housings portions 604, 606. A more detailed illustration of the face 641 of the first and second contact housing portions 604, 606 is shown in FIG. 7. In the example illustrated in FIG. 6, the first contact leaf 638, the second contact leaf 640, and the third contract leaf 642 extend the same distance external to the face 641 of the first and second contact housing portions 604, 606. In other examples, the first contact leaf 638, the second contact leaf 640, and the third contract leaf 642 may extend a first distance, a second distance, and a third distance external to the face 641 of the first and second contact housing portions 604, 606. In such other examples, the first distance, second distance, and third distance may be three different distances, two equal distances and one different distance, etc.

In the illustrated example of FIG. 6, the magnet assembly 610, includes an example switch actuator 650, an example first magnet 652, and an example second magnet 654. The switch actuator 650 includes an example fork 651. In examples disclosed herein, the fork 651 is illustrated as a u-shaped fork. When assembled, the switch actuator 650 is mechanically coupled to the first magnet 652. Additionally, the fork 651 receives and/or otherwise engages the third contact leaf 642 when assembled. Therefore, the third contact leaf 642 is operatively coupled to the first magnet 652. In operation, the presence of a target (e.g., an external magnet, a ferrous object, etc.) proximate to (i.e., within a requisite range of) an example sensing field 664 of the switch 600 causes movement of the first magnet 652 and, thereby causing the switch actuator 650 to translate and cause the third contact leaf 642 to abut either the first contact leaf 638 or the second contact leaf 640. In particular, the switch actuator 650 is caused to translate by a repulsive or attractive force caused by at least the magnet assembly 610, thereby causing translation of the third contact leaf 642 to electrically coupled or de-couple the contact leaves 638, 640, 642 to/from one another.

In the example illustrated in FIG. 6, the example first magnet 652 and/or the example second magnet 654 are produced using rare earth metals rated to withstand temperatures in a high-heat environment. In some examples disclosed herein, the first magnet 652 and/or the second magnet 654 may be a samarium cobalt magnet rated to withstand temperatures in a high-heat environment. Alternatively, in other examples, the first magnet 652 and/or the second magnet 654 may be any suitable magnetic object (e.g., a ferrous object) rated to withstand temperatures in a high-heat environment (e.g., a neodymium magnet rated to withstand temperatures in a high-heat environment, etc.). In this manner, the switch actuator 650 is coupled to a magnet rated to withstand temperatures in a high-heat environment (e.g., the first magnet 652), when assembled.

In the example illustrated in FIG. 6, the first deformable sleeve 612, the second deformable sleeve 614, and/or the third deformable sleeve 616 are deformable metallic sleeves. In examples disclosed herein, the first deformable sleeve 612, the second deformable sleeve 614, and/or the third deformable sleeve 616 are produced using a stainless steel tube. For example, any of the first deformable sleeve 612, the second deformable sleeve 614, and/or the third deformable sleeve 616 may be a micro stainless steel tube, configured to receive corresponding contact leaves 638, 640, 642 and/or corresponding conductors 644, 646, 648. In other examples, the first deformable sleeve 612, the second deformable sleeve 614, and/or the third deformable sleeve 616 may be produced using any suitable material rated to withstand temperatures in a high-heat environment such as, for example, a high melting point metal (e.g., tungsten, molybdenum, tantalum, niobium, stainless steel, etc.), a plastic rated to withstand temperatures in a high-heat environment (e.g., polyimide, poly benz imidazol, etc.), etc.

In the example illustrated in FIG. 6, the first conductor 644, the second conductor 646, and/or the third conductor 648 are produced using glass reinforced cables. In this manner, example insulators 656, 658, 660 of the first conductor 644, the second conductor 646, and the third conductor 648, respectively, may be produced using glass. In other examples, the first conductor 644, the second conductor 646, and/or the third conductor 648 may be implemented using an alternative material for signal transmission such as, for example, optical fiber cables.

The example illustrated in FIG. 6 further includes an example jacket 662 to surround the insulators 656, 658, 660. In examples disclosed herein, the jacket 662 is an insulator rated to withstand temperatures in a high-heat environment such as, for example, glass. In other examples, the jacket 662 may be produced using any suitable jacket 662 rated to withstand temperatures in a high-heat environment such as, for example, alumina, aluminum oxide, fiberglass, ceramic, etc.

In the example illustrated in FIG. 6, the first deformable sleeve 612, the second deformable sleeve 614, and the third deformable sleeve 616 enable, when assembled, the crimping of the example of the first, second, and third contact leaves 638, 640, 642 to the first, second, and third conductors 644, 646, 648, respectively. In such a manner, structural characteristics of a PCB are not needed and, as such, a potting material rated to withstand temperatures in a high-heat environment (e.g., a ceramic epoxy) may be used to pot the example switch. In this manner, the potting material rated to withstand temperatures in a high-heat environment minimizes conductor movement.

While the example of FIG. 6 illustrates a single pole double throw switch, in some examples, a double-pole double throw switch may be implemented. Additionally, in other examples, the switch 600 of FIG. 6 may be a quick disconnect coupled switch. For example, when assembled, the first contact housing portion 604 may be coupled to the second contact housing portion 606 via any suitable quick disconnect method or apparatus. In yet another example, the first contact leaf 638, the second contact leaf 640, and/or the third contact leaf 642 may be coupled to corresponding conductors using any suitable quick disconnect method or apparatus. In such an example, the quick disconnect method or apparatus enables quick disconnect to an external system, device, and/or apparatus. Alternatively, any of the materials and/or methods disclosed herein may be utilized to insulate the switch 600 for increased transient temperature resistance.

FIG. 7 is an example enlarged view 700 of the actuator assembly 619 including the first, second, and third deformable sleeves 612, 614, 616 of FIG. 6. The actuator assembly 619, as illustrated in FIG. 7, includes the example first contact housing portion 604 and the example second contact housing portion 606. The first contact leaf 638 and the third contact leaf 642 extend away from the second contact housing portion 606. The second contact leaf 640 extends away from the first contact housing portion 604.

In FIG. 7, the first deformable sleeve 612, the second deformable sleeve 614, and/or the third deformable sleeve 616 are produced using a stainless steel tube. For example, any of the first deformable sleeve 612, the second deformable sleeve 614, and the third deformable sleeve 616 may be micro stainless steel sleeves, configured to receive corresponding contact leaves 638, 640, 642 and/or corresponding conductors 644, 646, 648, respectively. In other examples, the first deformable sleeve 612, the second deformable sleeve 614, and/or the third deformable sleeve 616 may be produced using any suitable material rated to withstand temperatures in a high-heat environment such as, for example, a high melting point metal (e.g., tungsten, molybdenum, tantalum, niobium, stainless steel, etc.), a plastic rated to withstand temperatures in a high-heat environment (e.g., polyimide, poly benz imidazol, etc.), etc.

Illustrated in FIG. 7, the first deformable sleeve 612 is crimped to the first contact leaf 638 and to the first conductor 644. For example, pressure is applied to the first deformable sleeve 612, thereby causing a deformation in the first deformable sleeve 612. Such a deformation places pressure on the first contact leaf 638 and the first conductor 644, thereby mechanically and electrically joining the first conductor 644 to the first contact leaf 638.

While FIG. 7 illustrates only the first deformable sleeve 612 as mechanically deformed, the second deformable sleeve 614 and/or the third deformable sleeve 616 may be mechanically deformed in a similar manner. In examples, any suitable method of crimping such as, for example, hexagonal crimping, indent crimping, quad-point crimping, hand crimping, notch crimping, etc., may be used.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

Example high temperature switch apparatus are disclosed herein. Further examples and combinations thereof include the following:

Example 1 includes an apparatus comprising a ceramic contact base having an opening therein configured to removably receive a contact, a first ceramic plunger housing portion and a second ceramic plunger housing portion, the first ceramic plunger housing portion including a first protrusion, the second ceramic plunger housing portion including a first recess, the first recess to receive the first protrusion, and a first ceramic contact housing portion and a second ceramic contact housing portion, the first ceramic contact housing portion including a second protrusion and a first cavity, the second ceramic contact housing portion including a second recess and a second cavity, the first ceramic plunger housing portion, the second ceramic plunger housing portion, and the ceramic contact base configured to be coupled between the first and second cavities when the second recess receives the second protrusion.

Example 2 includes the apparatus of example 1, wherein the ceramic contact base includes a second opening therein configured to removably receive a second contact.

Example 3 includes the apparatus of example 1, further including a plunger assembly, the plunger assembly coupled between the first ceramic plunger housing portion and the second ceramic plunger housing portion when the first recess receives the first protrusion.

Example 4 includes the apparatus of example 3, wherein the plunger assembly includes a shaft to pass through a bore of a magnet.

Example 5 includes the apparatus of example 4, wherein the shaft is mechanically coupled to a second magnet.

Example 6 includes the apparatus of example 5, wherein the magnet is a first magnet, and wherein the first and second magnets are rated to withstand temperatures in a high-heat environment.

Example 7 includes the apparatus of example 1, wherein the contact is movable to abut a second contact when an object is located within a sensing field of the apparatus.

Example 8 includes the apparatus of example 7, wherein the second contact is removably coupled to the ceramic contact base.

Example 9 includes the apparatus of example 1, wherein the first ceramic contact housing portion and the second ceramic contact housing portion form a single ceramic contact housing.

Example 10 includes the apparatus of example 1, wherein the first ceramic contact housing portion includes a third protrusion, the second ceramic contact housing portion includes a third recess configured to receive the third protrusion of the first ceramic contact housing portion.

Example 11 includes the apparatus of example 1, wherein the first ceramic plunger housing portion includes a third protrusion, the second ceramic plunger housing portion includes a third recess to receive the third protrusion of the first ceramic plunger housing portion.

Example 12 includes a magnetically-triggered proximity switch comprising a contact assembly including a first contact, a second contact, and a third contact, a first deformable metallic sleeve including a proximal end and a distal end, the proximal end crimped to the first contact, the distal end crimped to a first conductor, a second deformable metallic sleeve including a proximal end and a distal end, the proximal end crimped to the second contact, the distal end crimped to a second conductor, a third deformable metallic sleeve including a proximal end and a distal end, the proximal end crimped to the third contact, the distal end crimped to a third conductor, and a switch actuator to translate the third contact when an object is within a threshold sensing zone of the magnetically-triggered proximity switch.

Example 13 includes the magnetically-triggered proximity switch of example 12, wherein the first contact and the second contact are stationary and the third contact translates to abut the first contact and the second contact.

Example 14 includes the magnetically-triggered proximity switch of example 13, wherein the third contact translates to abut the first contact when the object is located within the threshold sensing zone of the magnetically-triggered proximity switch.

Example 15 includes the magnetically-triggered proximity switch of example 12, wherein the first contact, the second contact, and the third contact extend a distance external to a face of a housing.

Example 16 includes the magnetically-triggered proximity switch of example 12, wherein the first, second, and third deformable metallic sleeves are stainless steel sleeves.

Example 17 includes the magnetically-triggered proximity switch of example 12, wherein the first, second, and third deformable metallic sleeves are external to a face of a housing.

Example 18 includes the magnetically-triggered proximity switch of example 12, wherein the switch actuator includes a fork to engage the third contact and the third contact is operatively coupled to a magnet rated to withstand temperatures in a high-heat environment.

Example 19 includes the magnetically-triggered proximity switch of example 12, further including a first housing portion and a second housing portion, the first housing portion and the second housing portion made of ceramic.

Example 20 includes the magnetically-triggered proximity switch of example 19, wherein the first housing portion includes a protrusion and the second housing portion includes a recess to receive the protrusion.

The following claims are hereby incorporated into this Detailed Description by this reference, with each claim standing on its own as a separate embodiment of the present disclosure.

What is claimed is:

1. An apparatus comprising:

a ceramic contact base having an opening therein configured to removably receive a contact;

a first ceramic plunger housing portion and a second ceramic plunger housing portion, the first ceramic plunger housing portion including a first protrusion, the second ceramic plunger housing portion including a first recess, the first recess to receive the first protrusion; and a first ceramic contact housing portion and a second ceramic contact housing portion, the first ceramic contact housing portion including a second protrusion and a first cavity, the second ceramic contact housing portion including a second recess and a second cavity, the first ceramic plunger housing portion, the second ceramic plunger housing portion, and the ceramic contact base configured to be coupled between the first and second cavities when the second recess receives the second protrusion.

2. The apparatus of claim 1, wherein the ceramic contact base includes a second opening therein configured to removably receive a second contact.

3. The apparatus of claim 1, further including a plunger assembly, the plunger assembly coupled between the first ceramic plunger housing portion and the second ceramic plunger housing portion when the first recess receives the first protrusion.

4. The apparatus of claim 3, wherein the plunger assembly includes a shaft to pass through a bore of a magnet.

5. The apparatus of claim 4, wherein the shaft is mechanically coupled to a second magnet.

6. The apparatus of claim 5, wherein the magnet is a first magnet, and wherein the first and second magnets are rated to withstand temperatures in a high-heat environment.

7. The apparatus of claim 1, wherein the contact is movable to abut a second contact when an object is located within a sensing field of the apparatus.

8. The apparatus of claim 7, wherein the second contact is removably coupled to the ceramic contact base.

9. The apparatus of claim 1, wherein the first ceramic contact housing portion and the second ceramic contact housing portion form a single ceramic contact housing.

10. The apparatus of claim 1, wherein the first ceramic contact housing portion includes a third protrusion, the second ceramic contact housing portion includes a third recess configured to receive the third protrusion of the first ceramic contact housing portion.

11. The apparatus of claim 1, wherein the first ceramic plunger housing portion includes a third protrusion, the second ceramic plunger housing portion includes a third recess to receive the third protrusion of the first ceramic plunger housing portion.

* * * * *